US005720185A

United States Patent [19]

Lee

[11] Patent Number: 5,720,185

[45] Date of Patent: Feb. 24, 1998

[54] REFRIGERATOR HAVING A COOL AIR DISPERSING SHELF

[75] Inventor: Sang-Moo Lee, Incheon, Rep. of Korea

[73] Assignee: Daewoo Electronics Co., Ltd., Seoul, Rep. of Korea

[21] Appl. No.: 664,008

[22] Filed: Jun. 14, 1996

[30] Foreign Application Priority Data

Jun. 16, 1995 [KR] Rep. of Korea ..... 95-15985

[51] Int. Cl.[6] ..... F25D 17/04

[52] U.S. Cl. ..... 62/408; 62/329; 62/455

[58] Field of Search ..... 62/407, 408, 329, 62/454, 455

[56] References Cited

U.S. PATENT DOCUMENTS

| | | | |
|---|---|---|---|
| 1,922,456 | 8/1933 | Powell | 62/408 |
| 3,027,732 | 4/1962 | Mann et al. | 62/329 |
| 4,467,618 | 8/1984 | Gidseg | 62/187 |
| 4,662,186 | 5/1987 | Park | 62/265 |
| 4,671,074 | 6/1987 | Gostelow et al. | 62/186 |
| 4,989,347 | 2/1991 | Kretchman | 34/133 |
| 5,577,822 | 11/1996 | Seon | 312/404 |

*Primary Examiner*—William Doerrler

*Attorney, Agent, or Firm*—Beveridge, DeGrandi, Weilacher & Young LLP

[57] ABSTRACT

A refrigerator having a cool air dispersing shelf is inherently installed with a dispersing apparatus for spreading the cool air to the shelf for consistently dispersing the cool air throughout the interior of a cooling chamber within a short time period, and supplies the cool air to respective shelves simply by installing/removing the shelves. For this, a supply duct circulated with the cool air supplied into the cooling chamber therethrough has at least one discharging hole toward the cooling chamber, and an open/close member is installed in the supply duct for opening/closing the discharging hole in accordance with the installation/separation of the shelf. Also, the shelf is formed with cool air spray holes in the lower plane and a pushing portion provided by one end of a cool air suction hole for opening/closing the open/close member.

3 Claims, 4 Drawing Sheets

REFRIGERATOR HAVING A COOL AIR DISPERSING SHELF

BACKGROUND OF THE INVENTION

1. Field of the Invention

The present invention relates to a refrigerator having an apparatus for effectively dispersing cool air, and more particularly to a refrigerator having a cool air dispersing shelf, wherein cool air is dispersely supplied to a shelf furnished to be installed within the refrigerator for making temperature distribution consistent throughout the refrigerator.

2. Description of the Prior Art

In a conventional refrigerator, cool air at a low temperature generated from an evaporator is supplied to a freezing chamber and a cooling chamber by the rotation of a fan. Along with the increase of a retaining capacity, however, the cool air is inconsistently circulated within the cooling chamber when the cool air is simply supplied via a cool-air supply duct solely. For this reason, only a specific place of receiving the cool air is in the low temperature state. Furthermore, the supplied cool air is not consistently distributed throughout the interior of the cooling chamber due to shelves accommodated thereto. Consequently, the temperature within the cooling chamber becomes inconsistent which, in turn, shortens an available storage period and lowers freshness of food.

In order to solve the above-stated problems, U.S. Pat. Nos. 4,671,074 and 5,907,675 disclose a refrigerator for controlling circulation of cool air.

FIG. 1 illustrates a sectional view in perspective of one example of the conventional refrigerator having a cool air dispersing apparatus.

Referring to FIG. 1, several shelves are placed across a space provided by both side planes 5 and a rear plane 7 of a cooling chamber. A supply duct 9 of the cool air is formed in the up and down direction in the center of rear side 7, and a plurality of cool-air discharging holes 11 are formed in supply duct 9 toward the interior of the cooling chamber.

Respective shelves 1 have a flat surface for sustaining food or containers of food, which are upheld by a pair of shelf support stands projecting from side planes 5. Also, shelves 1 can be adapted for user's convenience in such a manner that they are drawn out to be fitted to suit with the size of food desired to be stored and are situated at respective stairs.

The conventional refrigerator having the above-described construction is operated as below. The cool air generated from an evaporator (not shown) is supplied to the interior of the cooling chamber by means of a blower fan (not shown). The supplied cool air flows downward along supply duck 9 of the cooling chamber to be dispersed into the interior of the cooling chamber via discharging holes 11 by a pressure difference.

However, according to the cool-air dispersing apparatus of the conventional refrigerator constructed as above, the temperature is lower than a predetermined temperature around discharging holes 11 which supply the cool air while the temperature becomes relatively high around both side planes 5 or the door without being supplied with the cool air so far. Therefore, the temperature distribution throughout the cooling chamber is inconsistent to degrade freshness of the food. In addition, the discharged cool air is obstructed by the shelves to deleteriously impede smooth air circulation within the cooling chamber.

SUMMARY OF THE INVENTION

The present invention is devised to solve the foregoing problems. Therefore, it is an object of the present invention to provide a refrigerator having a cool air dispersing shelf, wherein a dispersing apparatus capable of spreading the cool air is inherently installed to the shelf for sustaining food thereon for consistently dispersing the cool air throughout the interior of a cooling chamber within a short time period.

It is another object of the present invention to provide a refrigerator having a cool air dispersing shelf, wherein a supply duct is automatically cut off when a user draws out the shelf as required to prevent unnecessary discharging of the cool air and, vice versa, the cool air is automatically supplied to the interior of the shelf when the shelf is furnished.

To achieve the above object of the present invention, a refrigerator having a cool air dispersing shelf includes a supply duct circulated with the cool air which is supplied into a cooling chamber, and at least one discharging hole is formed to the supply duct toward the cooling chamber. An open/close member is installed in the supply duct for opening/closing the discharging hole in accordance with the shelf whether it is furnished or not. Here, the shelf is formed with cool air spray holes in the lower plane and a cool air suction hole communicated with the cool air spray holes in a portion corresponding to the discharging hole, and one end of the cool air suction hole is formed with a pushing portion extending toward the open/close member.

Preferably, the open/close member includes a damper fixed by a hinge for being capable of swinging within the supply duct, and a spring installed to the hinge for exerting an elastic force upon the damper. Also, the cool air dispersing shelf is assembled by coupling a projecting portion formed from the lower plane of an upper shelf and a groove portion formed in the upper plane of a lower shelf.

It is preferable that the cool air spray holes are arranged in the lower plane of the shelf in plural spaced apart from one another by a predetermined interval.

Alternatively, to achieve the above object, a refrigerator having a cool air dispersing shelf includes a supply duct circulated with the cool air supplied into a cooling chamber and having at least one discharging hole toward the cooling chamber. A damper is fixed by a hinge for being capable of swinging within the supply duct, and a spring is installed to the hinge for exerting an elastic force upon the damper. Then, the shelf is formed with cool air spray holes in the lower plane, and assembled by coupling a projecting portion from the lower plane of an upper shelf with a groove portion in the lower plane of a lower shelf, in which the cool air spray holes are arranged in the lower plane of the shelf in plural spaced apart from one another by a predetermined interval, and a cool air suction hole communicated with the cool air spray holes in a portion corresponding to the discharging hole. Here, one end of the cool air suction hole constitutes a pushing portion extending to open the damper.

In the refrigerator having the cool air dispersing shelf according to the present invention as described above, when the shelf is inserted to the interior of the cooling chamber, the pushing portion pushes the damper to communicate the supply duct and cool air suction hole with each other. Then, the cool air flowing through the supply duct advances into the cool air suction hole in the shelf via the discharging hole. The admitted cool air is consistently dispersed throughout the interior of the cooling chamber via the cool air spray holes.

Also, when the shelf is drawn out of the cooling chamber as required, the pushing portion is pulled out together with the shelf to force the damper to close the discharging hole by the elastic force of the spring. By doing so, the cool air is not supplied when the shelf is not provided thereto.

By this construction, the refrigerator having the cool air dispersing shelf according to the present invention can consistently spread the cool air throughout the interior of the cooling chamber within a short time period. Therefore, the food is preserved for a long time period and freshness of the food is enhanced. Moreover, the discharging hole can be open/closed simply by installing/removing the shelf to facilitate the refrigerator in service.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

Figure 1:
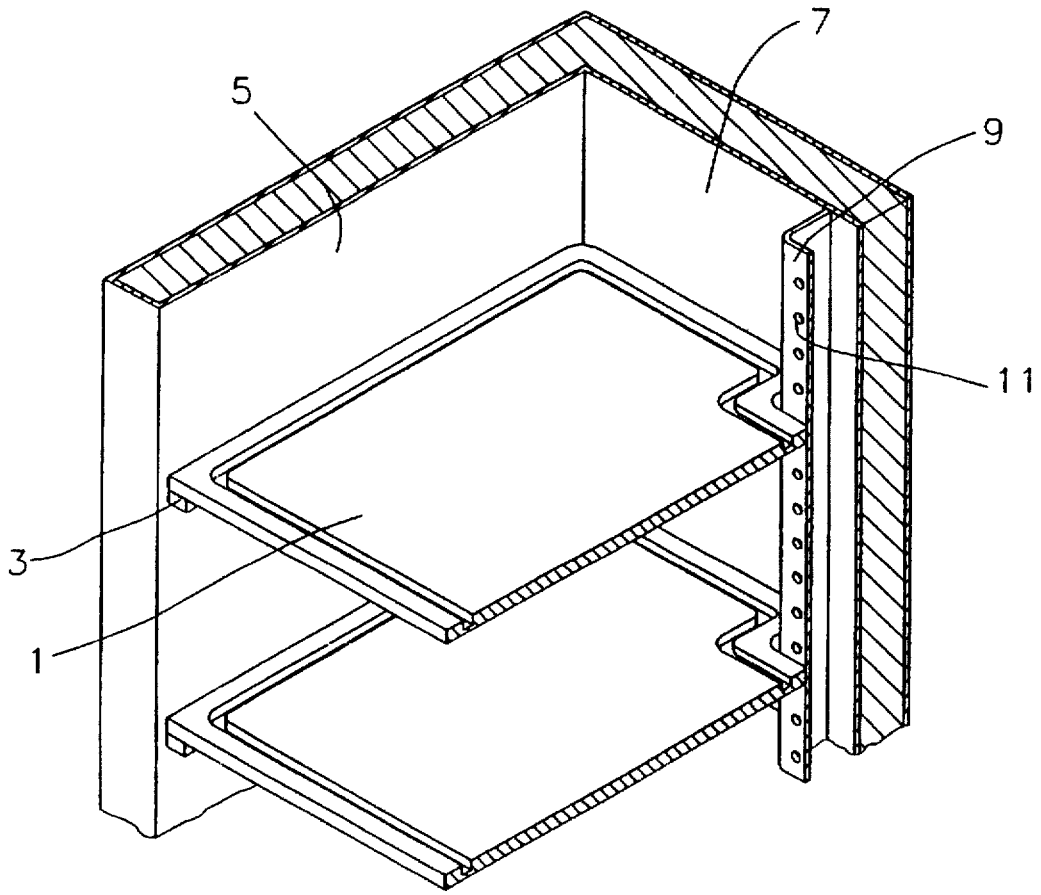
FIG. 1 PRIOR ART
FIG. 1 is a sectional view in perspective of a conventional refrigerator having a cool air dispersing apparatus.
Figure 2:
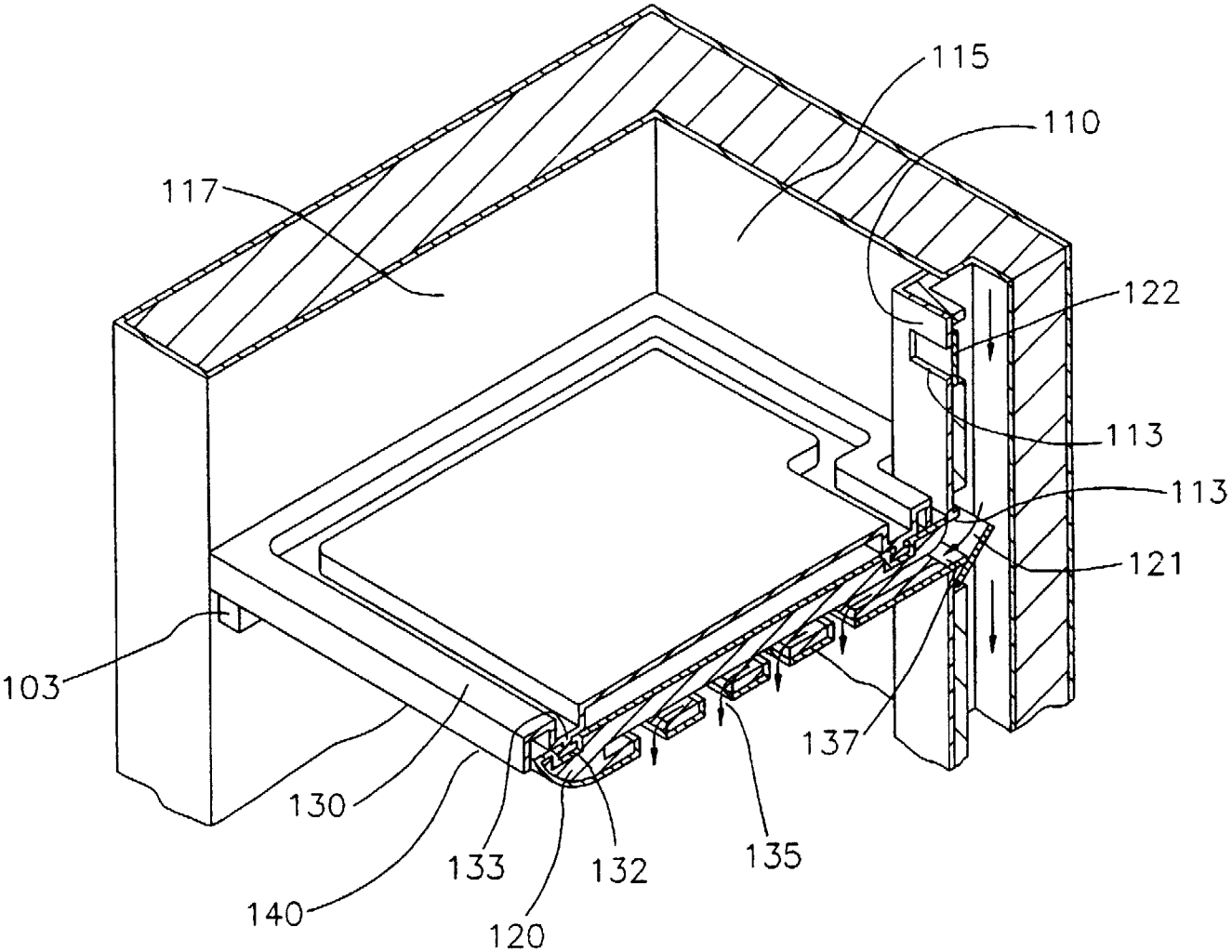
FIG. 2 is a sectional view in perspective of one embodiment of a refrigerator having a cool air dispersing shelf according to the present invention.

Referring to FIG. 2, one embodiment of a refrigerator having a cool air dispersing shelf according to the present invention is largely formed by a shelf 120 for dispersing cool air and a cooling chamber.

The cooling chamber is encased by both side planes 117 and a rear plane 115. A supply duct 110 of the cool air penetrating up and down is formed in the center of rear plane 115. Shelf support stands 103 for supporting a shelf 140 project from opposite portions of both side planes 117.

Supply duct 110 partially protrudes toward the interior of the cooling chamber while penetrating in the center of rear plane 115 up and down, which has a hollowed structure for smoothly circulating the cool air. In supply duct 110, a discharging hole 113 for ejecting the cool air is provided where shelf support stands 13 for upholding cool air dispersing shelf 140 are formed. Discharging hole 113 is formed to be open/closed by a damper 121. Shelf support stands 103 and discharging hole 113 are arranged in plural within the cooling chamber in the up and down direction spaced by a prescribed interval.

FIG. 2 illustrates a state that a damper 122 is closed due to the removal of the shelf and damper 121 is open by a pushing portion 137 when shelf 140 is provided thereto.

The upper plane of cool air dispersing shelf 140 constitutes an upper shelf 130, and the lower plane constitutes a lower shelf 120 formed with a plurality of cool air spray holes 135 spaced by a regular interval. Upper shelf 130 is formed with a projecting portion 133 around shelf 120 in contact with lower shelf 120, and lower shelf 120 is formed with a groove portion 132 corresponding to projecting portion 133. By using this structure, projecting portion 133 and groove portion 132 are coupled with each other to assemble cool air dispersing shelf 140.

A portion of lower shelf 120 contacting discharging hole 113 protrudes to extend toward damper 121 to form pushing portion 137 which pushes damper 121 when cool air dispersing shelf 140 is furnished to supply the cool air within supply duct 110 to the interior of lower shelf 120. Accordingly, the length of pushing portion 137 should be long enough to swing damper 121 by as much as a predetermined angle.

Figure 3:
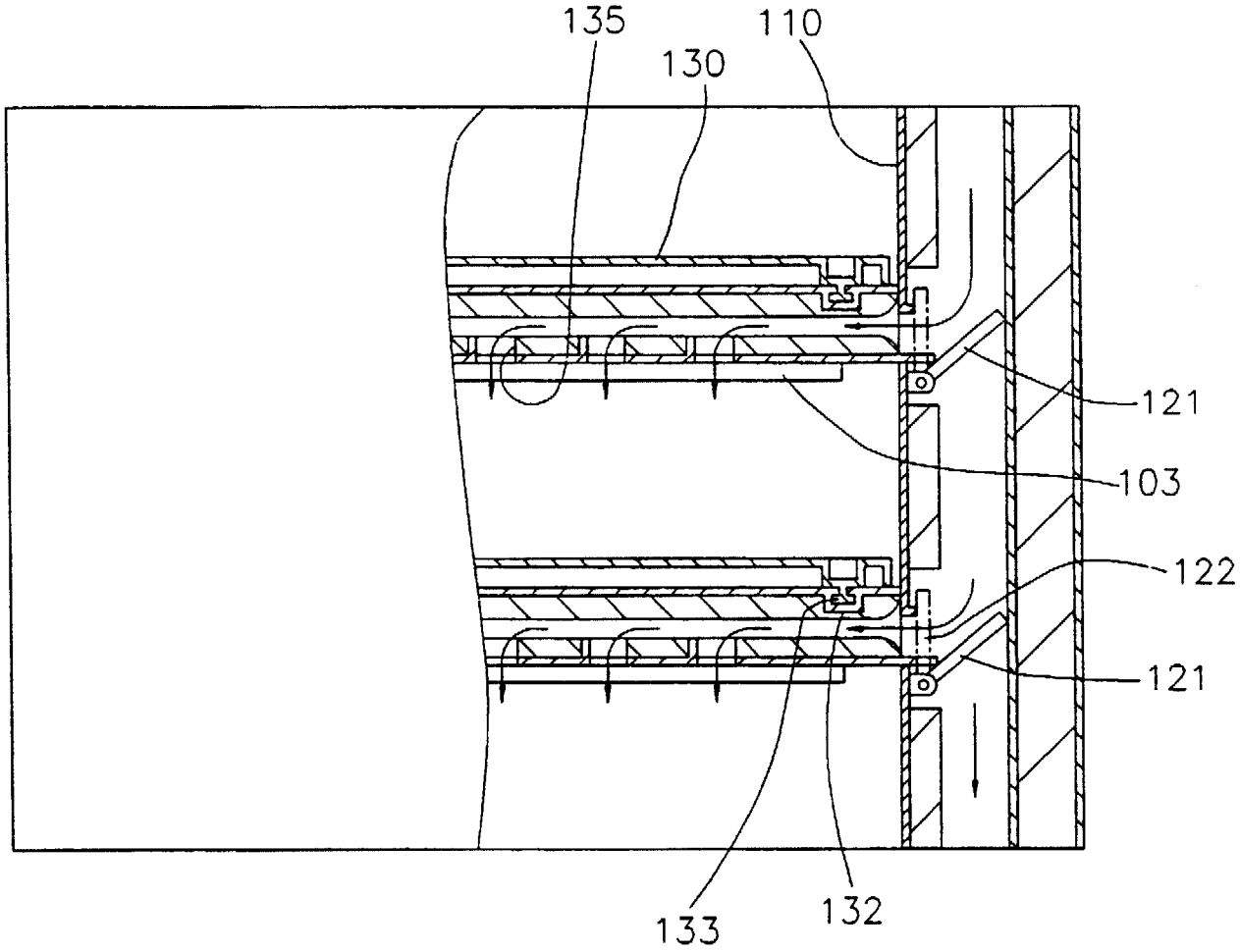
FIG. 3 is a side view, partially in cross-section, of the refrigerator shown in FIG. 2.

FIG. 3 is a side view, partially in cross-section, of the refrigerator shown in FIG. 2. As shown in FIG. 3, discharging holes 113 are formed in vertically-installed supply duct 110 to be spaced apart from one another by the prescribed interval, and respective cool air dispersing shelves 140 are retainable to respective discharging holes 113.

Cool air spray holes 135 are communicated with supply duct 110 when shelf 140 is retained, and the middle layer of lower shelf 120 is provided with a space for allowing the cool air to flow therethrough.

In FIG. 3, arrows designate a direction of supplying the cool air, and solid-lined damper 121 is in the state of being open by pushing portion 137. Dotted-lined damper 122 is in the closed state when cool air dispersing shelf 140 is drawn out of the cooling chamber.

Figure 4:
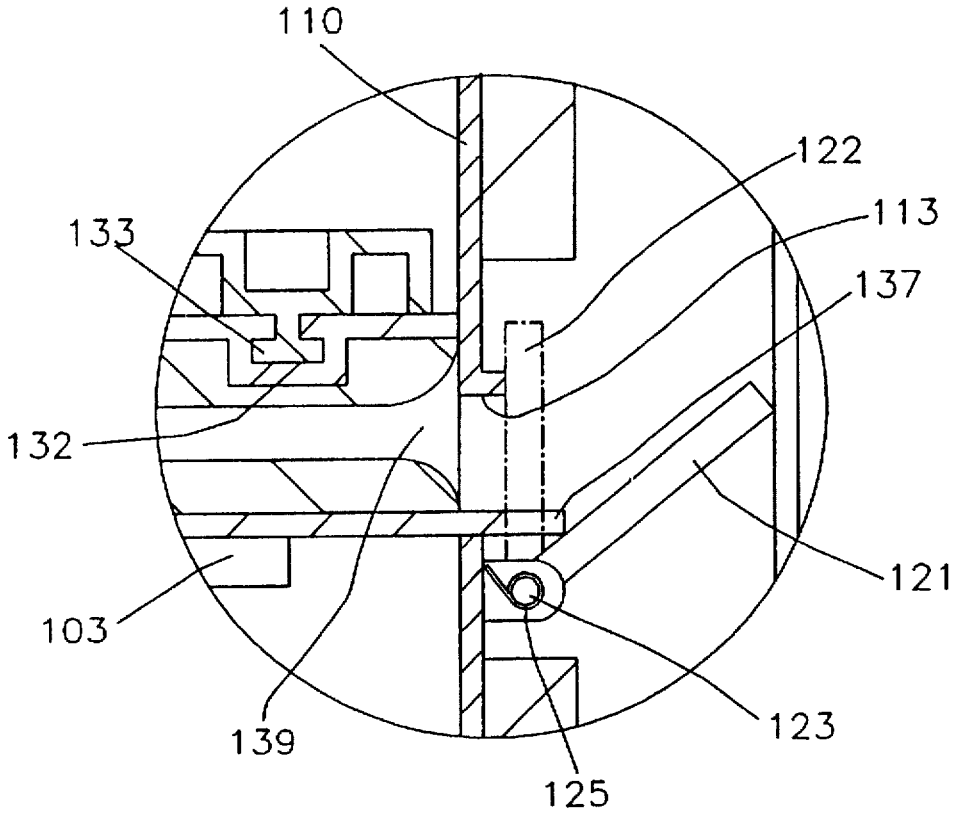
FIG. 4 is an enlarged sectional view showing the damper of FIG. 3.

FIG. 4 is an enlarged sectional view showing the damper of FIG. 3. A hinge 123 is installed to the inner wall of supply duct 110 to fix damper 121, and a spring 125 is installed to close damper 121 in the direction of discharging holes 113.

A cool air suction hole 139 having an enlarged inlet is formed where cool air dispersing shelf 140 contacts discharging hole 1213 with each other to smoothly supply the cool air from supply duct 110 to lower shelf 120. Such cool air dispersing shelf 140 is sustained from the lower portion by shelf support stands 103.

The lower plane of cool air suction hole 139 protrudes to extend toward damper 121, thereby forming pushing portion 137. Shelf support stands 103 are high to be identical with discharging hole 113 for permitting pushing portion 137 to advance into discharging hole 113 when cool air dispersing shelf 140 is furnished.

Here, damper 122 illustrates the state of cutting off discharging hole 113 by the elastic force of spring 125 under the state that shelf 120 is not provided.

An operation of the refrigerator having the shelf for dispersing the cool air according to the present invention is executed as follows.

If cool air dispersing shelf 140 is intended to be accommodated, the user places shelf 140 across the upper portions of shelf support stands 103 and pushes shelf 140 into the cooling chamber toward rear plane 115. Once shelf 140 contacts rear plane 115, pushing portion 137 pushes closed damper 122 while overcoming the elastic force of spring 125. Damper 122 pushed by pushing portion 137 swings about hinge 123 to open supply duct 110. Then, cool air suction hole 139 is closely attached to discharging hole 113 to form a duct for supplying the cool air to lower shelf 120.

By this operation, the cool air generated from an evaporator passes through cool air suction hole 139 of shelf 140 via opened damper 121 while flowing through supply duck 110. The cool air having passed through cool air suction hole 139 passes through the space provided in the middle layer of lower shelf 120 to be consistently supplied to all parts of the cooling chamber via cool air spray holes 135.

On the contrary, if cool air dispersing shelf 140 is to be separated from the cooling chamber as required, the user simply draws out shelf 140 toward the door direction to separate it out of the cooling chamber. Then, while pushing portion 137 is released from discharging hole 113, damper 121 cuts off discharging hole 113 by the elastic force of spring 125. That is, damper 121 becomes damper 122 in the closed state illustrated in FIG. 4. By this operation, the cool air produced from the evaporator is not supplied to the interior of the cooling chamber through discharging hole 113 but circulates within supply duct 110 or passes through open discharging holes 113 in other portions.

In one embodiment of the present invention, upper shelf 130 and lower shelf 120 are assembled with each other by means of projecting portion 133 and groove portion 132. When required, upper shelf 130 and lower shelf 120 may be molded in a body.

As a result, the refrigerator having the cool air dispersing shelf according to the present invention quickly and consistently supplies the cool air throughout the interior of the cooling chamber. By doing so, the freshness of the food can be maintained while preserving the food for a long time period.

Furthermore, the cool air is supplied to respective shelves by simply furnishing or separating the shelves without causing the user inconvenience of separately manipulating a cool air supply apparatus.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A refrigerator having a cool air dispersing shelf comprising:

a supply duct being circulated with said cool air supplied into a cooling chamber and having at least one discharging hole toward said cooling chamber;

a damper fixed by a hinge for being capable of swinging within said supply duct;

a spring installed to said hinge for exerting an elastic force upon said damper;

said shelf formed with cool air spray holes in the lower plane and a cool air suction hole communicated with said cool air spray holes in a portion corresponding to said discharging hole, one end of said cool air suction hole formed with a pushing portion extending toward said damper; and wherein said cool air dispersing shelf is assembled by coupling a projecting portion formed from the lower plane of an upper shelf and a groove portion formed in the upper plane of a lower shelf.

2. A refrigerator having a cool air dispersing shelf comprising:

a supply duct being circulated with said cool air supplied into a cooling chamber and having at least one discharging hole toward said cooling chamber;

a damper fixed by a hinge for being capable of swinging within said supply duct;

a spring installed to said hinge for exerting an elastic force upon said damper;

said shelf formed with cool air spray holes in the lower plane and a cool air suction hole communicated with said cool air spray holes in a portion corresponding to said discharging hole, one end of said cool air suction hole formed with a pushing portion extending toward said damper;

said cool air spray holes for ejecting said cool air are arranged in said lower plane of said shelf and spaced apart from one another by a predetermined interval; and wherein said cool air dispersing shelf is assembled by coupling a projecting portion formed from the lower plane of an upper shelf and a groove portion formed in the upper plane of a lower shelf.

3. A refrigerator having a cool air dispersing shelf comprising:

a supply duct being circulated with said cool air supplied into a cooling chamber and having at least one discharging hole toward said cooling chamber;

a damper fixed by a hinge for being capable of swinging within said supply duct;

a spring installed to said hinge for exerting an elastic force upon said damper; and said shelf formed with cool air spray holes in the lower plane, assembled by coupling a projecting portion from the lower plane of an upper shelf with a groove portion in the lower plane of a lower shelf, and formed with a cool air suction hole communicated with said cool air spray holes in a portion corresponding to said discharging hole, one end of said cool air suction hole formed with a pushing portion extending for opening said damper.

* * * * *